US008267493B2

(12) United States Patent
Kim

(10) Patent No.: US 8,267,493 B2
(45) Date of Patent: Sep. 18, 2012

(54) REFRIGERATOR

(75) Inventor: Seong Wook Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 258 days.

(21) Appl. No.: 12/634,393

(22) Filed: Dec. 9, 2009

(65) Prior Publication Data

US 2010/0176704 A1 Jul. 15, 2010

Related U.S. Application Data

(60) Provisional application No. 61/145,048, filed on Jan. 15, 2009.

(51) Int. Cl.
*A47B 96/04* (2006.01)

(52) U.S. Cl. ..... 312/408; 312/404; 312/311; 312/350; 108/106

(58) Field of Classification Search ..... 312/404, 312/408, 311, 350, 306, 312; 108/147, 147.11, 108/147.12, 106–110
See application file for complete search history.

(56) References Cited

U.S. PATENT DOCUMENTS 765,347 A * 7/1904 Vogel ..... 187/268
831,994 A * 9/1906 Rudman ..... 254/95
911,843 A * 2/1909 Sample ..... 62/379
2,224,543 A * 12/1940 Harman ..... 108/147
2,836,305 A * 5/1958 Davey et al. ..... 108/138
2,861,695 A * 11/1958 Carbary ..... 108/138
3,058,320 A * 10/1962 Foster et al. ..... 62/382
3,761,152 A * 9/1973 Cory ..... 312/7.2
3,982,801 A * 9/1976 Heidorn et al. ..... 312/306
5,299,863 A * 4/1994 Albright, Jr. ..... 312/404
6,065,821 A * 5/2000 Anderson et al. ..... 312/408
6,253,568 B1 * 7/2001 Peffley ..... 62/441
6,733,094 B1 * 5/2004 Chang ..... 312/7.2
6,883,887 B1 * 4/2005 Mogensen ..... 312/408
7,178,890 B2 * 2/2007 Park et al. ..... 312/408
7,611,111 B2 * 11/2009 Costa et al. ..... 248/243
7,766,437 B2 * 8/2010 Lim et al. ..... 312/408
2006/0169862 A1 * 8/2006 Liu ..... 248/422
2006/0290159 A1 * 12/2006 Rasmussen ..... 296/65.01
2009/0255292 A1 * 10/2009 Benz ..... 62/378
2010/0060124 A1 * 3/2010 Kang et al. ..... 312/408
2010/0176704 A1 * 7/2010 Kim ..... 312/408

* cited by examiner

*Primary Examiner* — Darnell Jayne
*Assistant Examiner* — Daniel Rohrhoff
(74) *Attorney, Agent, or Firm* — Birch, Stewart, Kolasch & Birch, LLP

(57) ABSTRACT

Provided is a refrigerator including a sliding storage member that is height adjustable through a vertically moving shelf with a multi-level configuration, and which can be selectively withdrawn from inside a storage space to the outside, where a user can improve usability of storage space in the refrigerator by selectively adjusting the height of the vertically moving shelf.

5 Claims, 4 Drawing Sheets

REFRIGERATOR

This Nonprovisional application claims priority under 35 U.S.C. §119(e) on U.S. Provisional Application No. 61/145,048 filed on Jan. 15, 2009, the entire contents of which are hereby incorporated by reference.

THE BACKGROUND

1. The Field

The present invention relates to a refrigerator.

2. Description of the Related Art

In general, a refrigerator is a household appliance for storing food at low temperatures over extended periods.

Specifically, depending on the locations of their refrigeration compartments and freezer compartments, refrigerators can be categorized into top mount refrigerators having the freezer compartment provided at the top, bottom freezer refrigerators having the freezer compartment provided at the bottom, and side by side refrigerators having the refrigeration compartment and freezer compartment arranged to the left and right of each other.

Also, a plurality of shelves on which food is placed, and box-shaped drawers open at the top for storing vegetables or fruit may be provided inside a refrigerator. Also, an ice maker may be installed within the freezer compartment or the refrigeration compartment, or on the rear of a door. In addition, depending on the product, a dispenser may be provided at the front of a refrigerator door to dispense water or ice, and a home bar structure may be provided on a refrigerator door to enable storing and removal of beverages or vessels filled with water without having to open a door of the refrigerator.

THE DETAILED DESCRIPTION

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
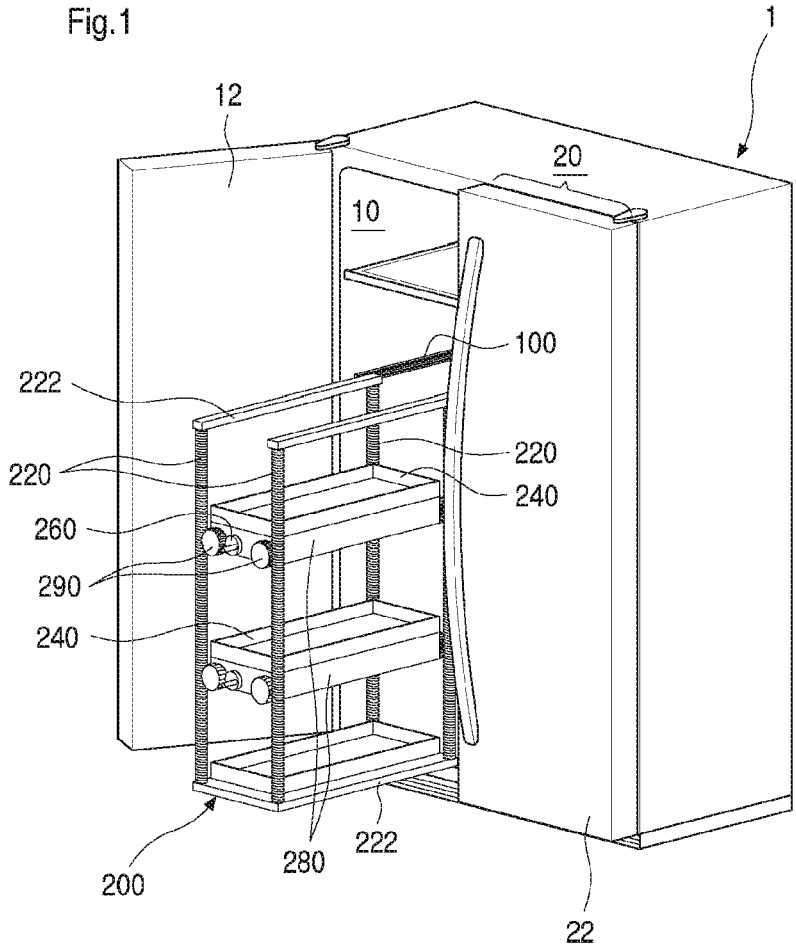
FIG. 1 is a perspective view showing a freezer compartment door of a refrigerator in an open state according to an embodiment of the present invention.

FIG. 1 is a perspective view showing a freezer compartment door of a refrigerator in an open state according to an embodiment of the present invention.

Referring to FIG. 1, a refrigerator 1 according to embodiments of the present invention has a storage space defined into a freezer compartment for storing food in a frozen state, and a refrigeration compartment 20 for storing food in refrigeration.

The freezer compartment 10 and the refrigeration compartment 20 are selectively closed by a freezer compartment door 12 and a refrigeration compartment door 22, respectively, that are mounted to be capable of pivoting on a side of the body of the refrigerator.

In addition, a plurality of shelves (not shown) on which food is placed may be provided in the freezer compartment 10 and the refrigeration compartment 20, and such shelves may be supported by support rails provided on either side of the freezer compartment 10 or refrigeration compartment 20 to be movable forward and rearward. Also, one or more of a cold air outlet may be provided in an inner surface of the freezer compartment 10 or the refrigeration compartment 20 to supply cold air.

A sliding storage member 200 may be provided within the freezer compartment 10, as shown, to be withdrawn forward along withdrawing rails 100. The sliding rails 100 may be respectively provided at positions on either inner sidewall of the refrigerator 10 corresponding to the top and bottom of the sliding storage member 200, and the sliding storage member 200 may be further provided with a frame 222 received in the withdrawing rail 100.

The sliding storage member 200 is provided with a plurality of item storage implements 240 in a multi-tiered and height-adjustable configuration, includes a vertically moving shelf 280 on which the item storage implement 240 is mounted and a vertically moving guide 220 that guides the movement of the vertically moving shelf 280, and may be provided with a mounting portion (not shown) for mounting the item storage implement 240 on the vertically moving shelf 280.

The vertically moving guide 220 is provided as a worm shaft defining screw threads sloped in one direction in the outer periphery thereof, and 2 each are provided at the front and rear to be capable of rotating while fixed to the frame 222. For this end, the connection between the frame 222 and the vertically moving guide 220 may be further provided with a bearing, and the frame 222 provided at the top is inserted and installed on the top end of the vertically moving guide 220 to be detachable.

Also, the vertically moving shelf 280 is formed in an approximately rectangular flat plate shape, and a vertically moving gear 290 is provided at the front and rear, respectively, thereof projecting outward and capable of rotating. Here, the vertically moving gear 290 is configured as a worm gear with teeth corresponding to the screw threads of the worm shaft.

Also, a height adjuster 260 for a user to adjust the height of the vertically moving shelf 280 is provided between the vertically moving gears 290.

Therefore, the height adjuster 260 may project outward in the shape of a handle.

Specifically, when a user grasps and rotates the height adjuster 260, the vertically moving gear 290 and the vertically moving guide 220 may rotate in concert to adjust the supporting height of the vertically moving shelf 280 and the item storage implement 240 mounted thereon.

A description on the operating structure of the vertically moving shelf 280 will be provided in further detail below with reference the drawings.

Figure 2:
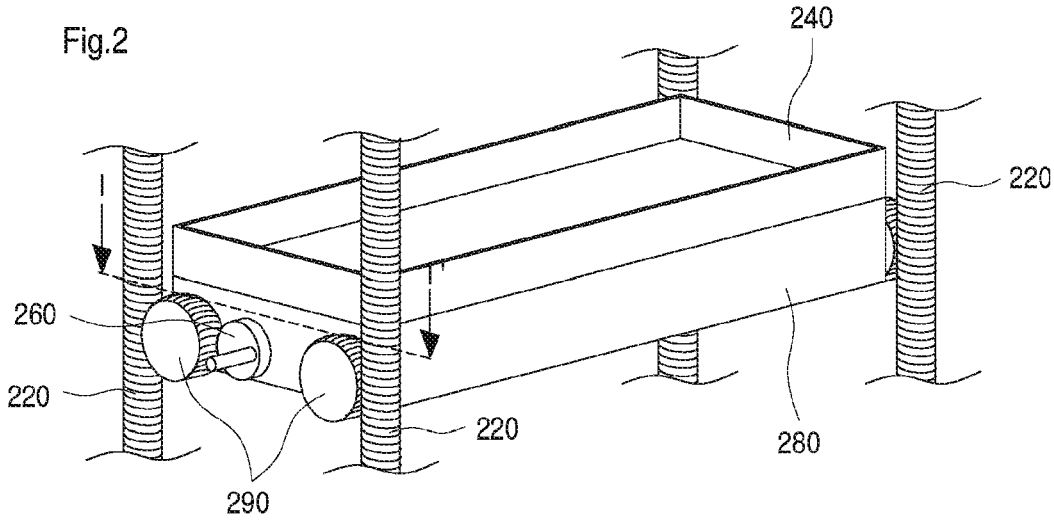
FIG. 2 is a perspective view showing a vertically moving shelf in a mounted state according to an embodiment of the present invention.
Figure 3:
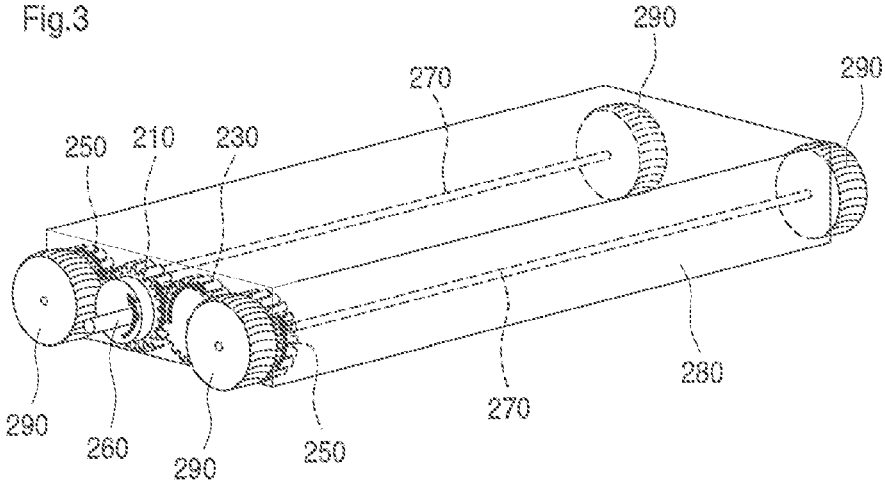
FIG. 3 is a diagram showing the operating structure of the vertically moving shelf in FIG. 2.
Figure 4:
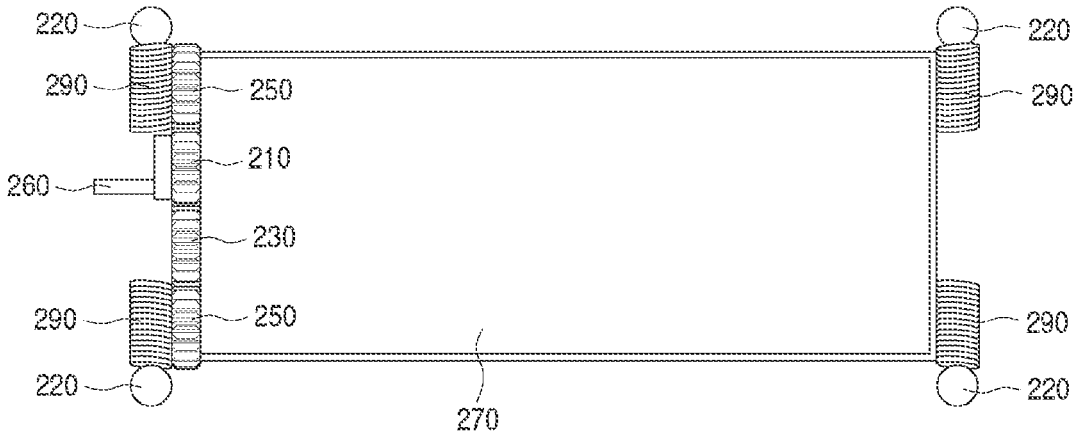
FIG. 4 is a sectional view of FIG. 2 taken along I-I'.

FIG. 2 is a perspective view showing a vertically moving shelf in a mounted state according to an embodiment of the present invention, FIG. 3 is a diagram showing the operating structure of the vertically moving shelf in FIG. 2, and FIG. 4 is a sectional view of FIG. 2 taken along I-I'.

As described above, the vertically moving shelf 280 is a rectangular flat plate at both sides of the front and rear on which the vertically moving gear 290 is fixed projecting outward in a rotatable manner, and a height adjuster 260 is provided to be rotatable between the vertically moving gears 290 for a user to apply manipulating force to.

Also, a drive gear 210 is further provided behind the height adjuster 260, and the drive gear 210 is co-axially coupled to rotate in concert with the height adjuster 260.

Further, a driven gear 250, for transmitting rotational force from the drive gear 210 to the vertically moving gear 290, is coupled coaxially to the vertically moving gear 290 provided at the left (in FIG. 3) of the drive gear 210 that is rotated as above.

A connecting gear 230 may be further provided at the right (in FIG. 3) of the drive gear 210.

The connecting gear 230 is provided to change the rotating direction of the driven gear 250 at the right (in FIG. 3) in order to adjust the height of the vertically moving shelf 280, by rotating the driven gear 250 at the right (for transmitting the rotational force to the vertically moving gear 290 provided at the right) together with the driven gear 250 at the left.

Also, a connecting shaft 270 is coupled to the driven gear 250 to transmit rotational force to the vertically moving gear 290 provided at the rear. Accordingly, when the height adjuster 260 is rotated, all the vertically moving gears 290 at the front and rear are rotated to perform height adjustment.

In a sliding storage member 200 according to an embodiment of the present invention, a plurality of vertically moving shelves 280 configured as above and the item storage implements 240 mounted thereon are provided in a multi-level configuration on the vertically moving guide 220, and here, the vertically moving gears 290 of the vertically moving shelves 280 provided at the top and bottom may have respectively different pitches.

Specifically, by making the pitch of the vertically moving shelf 280 provided at the bottom greater than the pitch of the vertically moving shelf 280 provided at the top, differences in moving speed and moving distance between the vertically moving shelves 280 at the top and bottom are created, so that when the height adjuster 260 is rotated, the gap between the vertically moving shelves 280 can be adjusted.

That is, by making the pitch of the vertically moving shelf 280 provided at the bottom greater by twofold or more than the pitch of the vertically moving shelf 280 provided at the top, the moving speed and moving distance of the vertically moving shelf 280 provided at the bottom is made to be faster and greater than those of the vertically moving shelf 280 provided at the top, in order to enable gap adjustment.

Figure 5:
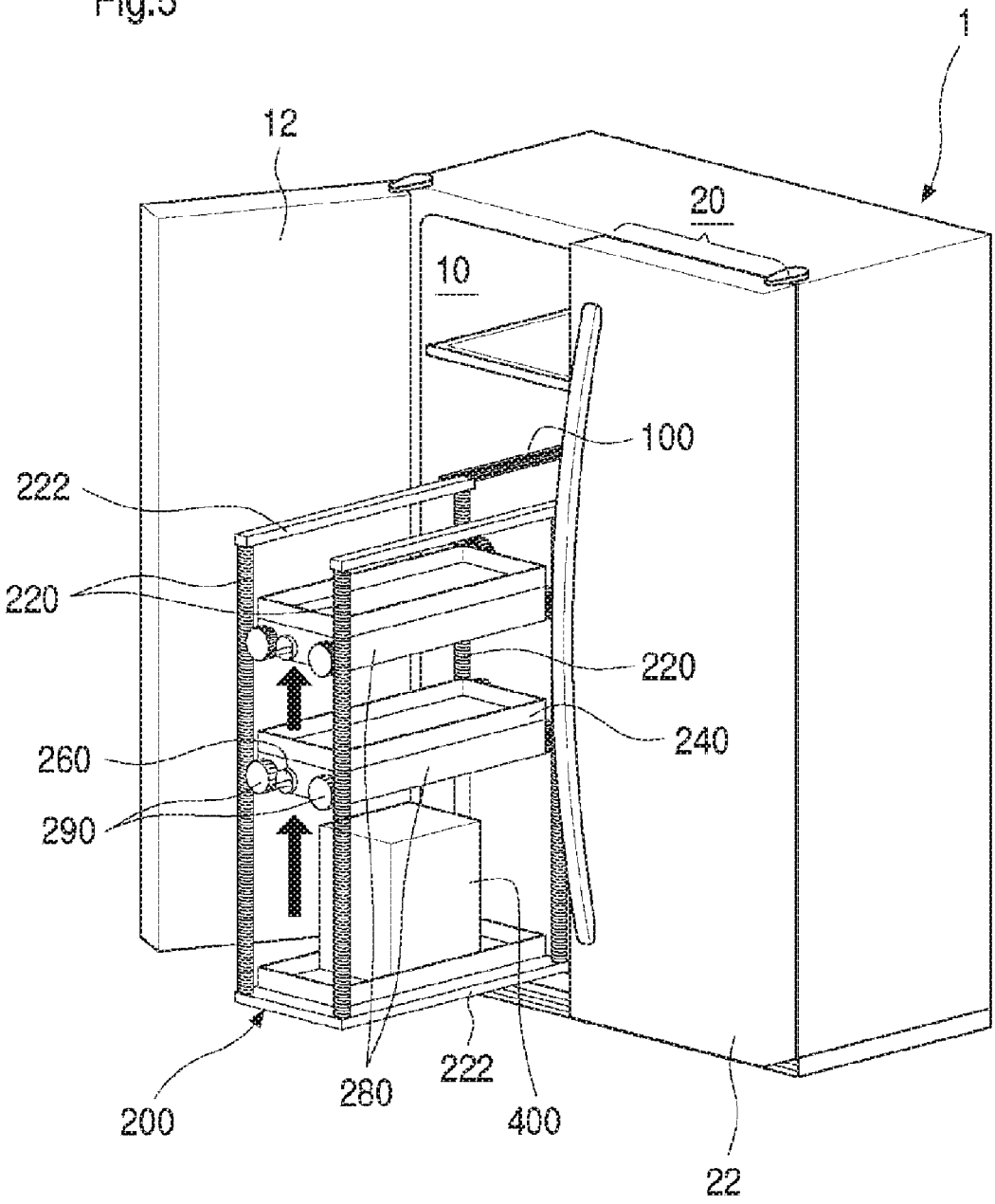
FIG. 5 is a diagram showing an example of use for a refrigerator according to an embodiment of the present invention.

FIG. 5 is a diagram showing an example of use for a refrigerator according to an embodiment of the present invention.

Referring to FIG. 5, when the vertically moving shelf 280 is initially mounted, the frame 222 provided at the top is first removed, and the vertically moving gears 290 are correspondingly positioned at the vertically moving guides 220, respectively, after which the height adjusters 260 are rotated and mounted one at a time.

That is, the vertically moving shelf 280 provided at the bottom is first mounted, and the vertically moving shelf 280 provided at the top is positioned at a predetermined height and then mounted using the same method, in order to dispose multilevel vertically moving shelves 280.

Then, when the approximate positions for the vertically moving shelves 280 are determined as described above, an item storage implement 240 may be mounted atop the vertically moving shelf 280 to receive a storage item 400, and a detached frame 222 may be mounted atop the vertically moving guide 220.

When the frame 222 is thus mounted, the sliding storage member 200 is made to be capable of sliding along the withdrawing rail 100 provided on the inner walls of the freezer compartment 10 to be withdrawn from and inserted in the freezer compartment 10.

Also, the vertically moving shelf 280 and the item storage implement 240 mounted thereon are adjusted in their supported height through rotating operation of the height adjuster 260.

Specifically, when a comparatively larger item is to be stored in the sliding storage member 200, the height adjuster 260 is manipulated to move the top/bottom vertically moving shelf 280 in an adjacent direction to enable the storage item 400 on the item storage implement 240 to be accommodated, and in the opposite case, the height adjuster 260 is rotated in the opposite direction as above to adjust the height of the vertically moving shelf 280.

The sliding storage member 200 may be configured to be adjustable in height by using the inserted and mounted height adjuster 260.

Another embodiment of the present invention will be described below with reference to the attached drawings.

Figure 6:
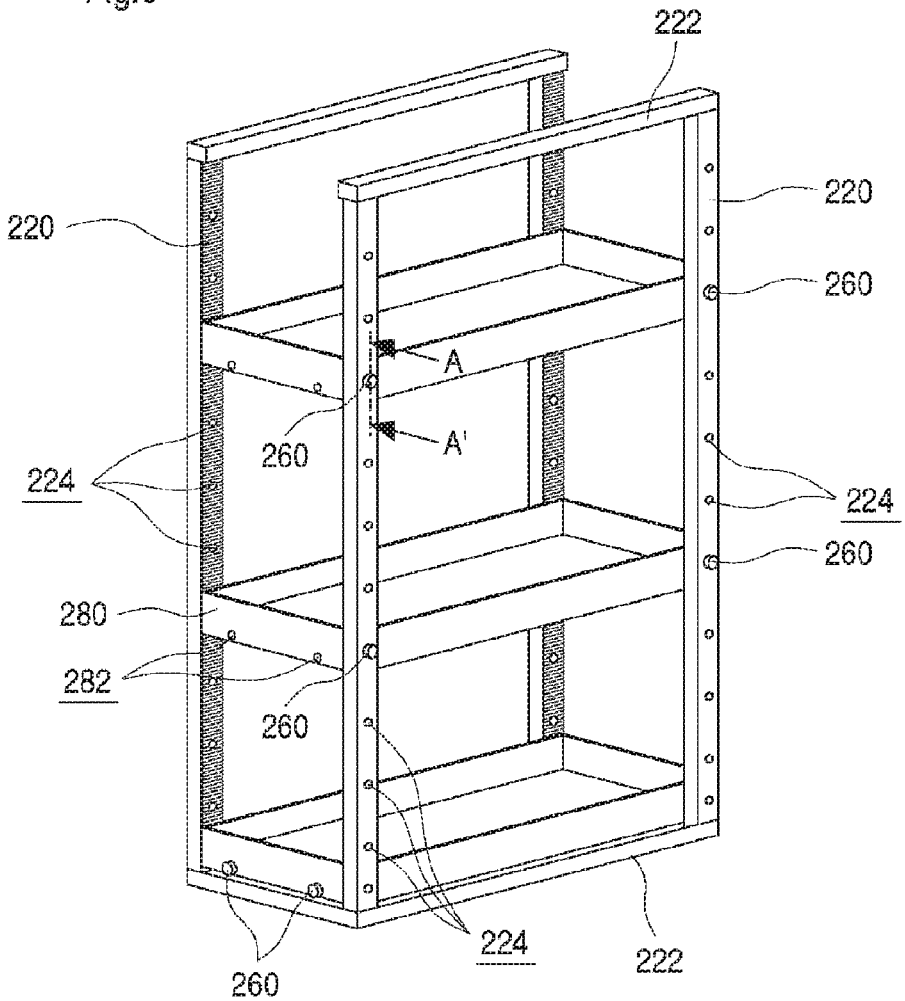
FIG. 6 is a perspective view showing a vertically moving shelf in a mounted state according to another embodiment of the present invention.
Figure 7:
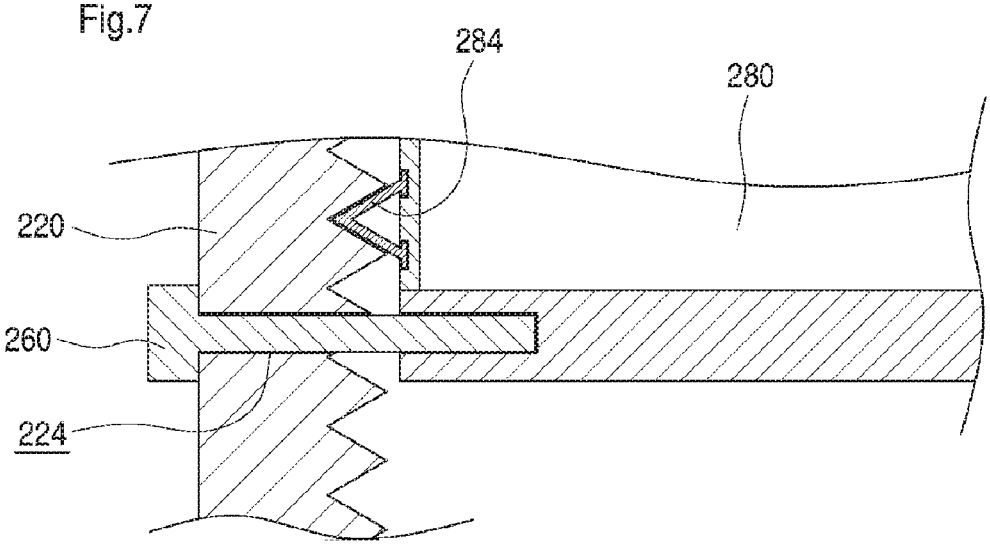
FIG. 7 is a sectional view of FIG. 6 taken along A-A'.

FIG. 6 is a perspective view showing a vertically moving shelf in a mounted state according to another embodiment of the present invention, and FIG. 7 is a sectional view of FIG. 6 taken along A-A'.

Referring to FIGS. 6 and 7, a sliding storage member 200 according to another embodiment of the present invention is configured to guide movement of a vertically moving shelf 280 along a vertically moving guide 220 that has a plurality of recesses and projections defined in alternation.

In detail, a biased catch 284 is formed projecting outward from portions at the left and right sides of the vertically moving shelf 280 that contact the vertically moving guides 220, so that the biased catch 284 is selectively impeded by the projections formed on the vertically moving guide 220 and catches in a recess.

For this purpose, the biased catch 284 may be formed as a triangular plate spring, and while not shown, may also be configured as a biasing spring and a projection pressed by the biasing spring.

The vertically moving shelf 280 that catches and is fixed by means of the above biasing catch 284 while sliding up or down is capable of being maintained fixed in a predetermined position on the vertically moving guide 220 by means of the height adjuster 260.

In detail, the height adjuster 260 is formed in a pin configuration with a predetermined diameter, and is inserted through the vertically moving guide 220 into the vertically moving shelf 280.

For this end, pin fastening holes 224, corresponding in inner diameter to the diameter of the height adjuster 260, are defined in plurality in the vertically moving guide 220 at predetermined intervals, and pin fastening holes 224 having the same inner diameter as the pin fastening holes 224 are also defined in the vertically moving shelf 280.

Also, when the height adjuster 260 is not inserted in the pin fastening hole 224 of the vertically moving shelf 280, a pin storage hole 282 may be further provided to store the height adjuster 260.

The floor of the vertically moving shelf 280 is formed of a thickness that can accommodate the diameter of the pin fastening hole 224 and the pin storage hole 282.

Thus, in the other embodiment of the present invention, after a user manually pushes the vertically moving shelf 280 upward or pulls it downward to fix its height, and the height adjuster 260 is inserted in the pin fastening holes 224 defined in the vertically moving guide 220 and the vertically moving shelf 280, in order to adjust the position of the vertically moving shelf 280.

Also, when the position of the vertically moving shelf 280 is not fixed, the height adjuster 260 can be inserted in the pin storage hole 282 provided in the vertically moving shelf 280, to prevent misplacement of the height adjuster 260.

What is claimed is:

1. A refrigerator, comprising:

a body including a cooling compartment having rails; and a storage rack positioned within the cooling compartment, the storage rack including:

a set of frames slidingly attached to the rails to enable the storage rack to be withdrawn from the cooling compartment in a first direction;

a set of moving guides to be connected between different pairs of the frames; and at least one moving shelf supported by the set of moving guides at desired positions along the set of moving guides and being movable in a second direction different from the first direction to other desired positions, wherein the at least one moving shelf includes:

a height adjuster used to move the at least one moving shelf in the second direction; and a set of moving gears to engage the set of moving guides, wherein the set of moving gears includes respective worm gears, and the set of moving guides includes respective worms engaged to the respective worm gears, wherein a rotation of the height adjuster in a first direction rotates a first pair of the set of moving gears in the first direction, and rotates a second pair of the set of moving gears in a second direction that is opposite to that of the first direction, to raise the at least one moving shelf, and wherein the first and second pairs of the set of moving gears respectively include a connecting shaft between the respective pairs of the moving gears, and a drive gear.

2. The refrigerator of claim 1, wherein the at least one moving shelf includes two moving shelves, a first of the two moving shelves is positioned over a second of the two moving shelves, and a pitch of the moving gear of the second of the moving shelves is greater than that of the first of the moving shelves so that a movement of the second of the two moving shelves is faster than a movement of the first of the two moving shelves in the second direction.

3. The refrigerator of claim 1, wherein the cooling compartment is a freezer compartment.

4. The refrigerator of claim 1, wherein the first direction is substantially perpendicular to the second direction.

5. The refrigerator of claim 1, further comprising:

a drive gear co-axially coupled to the height adjuster;

a connecting gear mating with the drive gear; and a pair of driven gears mating with the drive gear and the connecting gear, respectively, wherein each driven gear is co-axially coupled to each moving gear.

* * * * *